US010428503B2

(12) United States Patent
Gu

(10) Patent No.: US 10,428,503 B2
(45) Date of Patent: Oct. 1, 2019

(54) SUCTION DEVICE FOR WASTE DISCHARGE

(71) Applicant: Guoqing Gu, Shanghai (CN)

(72) Inventor: Guoqing Gu, Shanghai (CN)

( * ) Notice: Subject to any disclaimer, the term of this patent is extended or adjusted under 35 U.S.C. 154(b) by 0 days.

(21) Appl. No.: 15/770,404

(22) PCT Filed: Oct. 19, 2016

(86) PCT No.: PCT/CN2016/102542
§ 371 (c)(1),
(2) Date: Apr. 23, 2018

(87) PCT Pub. No.: WO2017/067452
PCT Pub. Date: Apr. 27, 2017

(65) Prior Publication Data

US 2018/0251969 A1 Sep. 6, 2018

(30) Foreign Application Priority Data

Oct. 23, 2015 (CN) ..... 2015 1 0688574
Jan. 14, 2016 (CN) ..... 2016 1 0023698
Aug. 2, 2016 (CN) ..... 2016 1 0626624

(51) Int. Cl.
*E03D 5/01* (2006.01)
*F04B 7/00* (2006.01)
*F04B 9/06* (2006.01)
*F04B 53/14* (2006.01)

(52) U.S. Cl.
CPC ..... *E03D 5/01* (2013.01); *F04B 7/00* (2013.01); *F04B 9/06* (2013.01); *F04B 53/14* (2013.01); *F04B 53/144* (2013.01); *F04B 53/146* (2013.01)

(58) Field of Classification Search
CPC ..... E03D 5/01
USPC ..... 4/431–433
See application file for complete search history.

(56) References Cited

U.S. PATENT DOCUMENTS

2008/0244819 A1* 10/2008 Meador ..... E03D 5/01

FOREIGN PATENT DOCUMENTS

CN 102477765 A * 5/2012 ..... E03D 5/01
CN 102912843 A * 2/2013 ..... E03D 5/01
CN 103290907 A * 9/2013 ..... E03D 5/01
CN 105155649 A * 12/2015 ..... E03D 5/01

* cited by examiner

*Primary Examiner* — Lori L Baker
(74) *Attorney, Agent, or Firm* — Gearhart Law LLC

(57) ABSTRACT

The present invention discloses a pumping drainage device for toilets, comprising a cylindrical shell, a cylinder cover, a cylinder sleeve, a piston and a lock tongue component, the shell is connected to the cylinder cover in the axial direction, the cylinder liner is sheathed in the cylinder cover, the piston is arranged in the cylinder liner, and the lock tongue component is arranged in the cylinder liner. The invention adopts two-stage movement of piston and cylinder liner, controlled by the lock tongue component, with the automatic reset function, greatly reducing the stroke of the piston under the status that the efficacy remains unchanged, with the advantages of compact structure, and easy operation, and good pumping effect.

15 Claims, 5 Drawing Sheets

SUCTION DEVICE FOR WASTE DISCHARGE

CLAIM OF PRIORITY

This application claims priority to PCT/CN2016/102542 filed on Oct. 19, 2016 which claims priority to CN201510688574.7 filed on Oct. 23, 2015 and CN201610626624.3 filed Aug. 2, 2016 and CN201610023698.8 filed on Jan. 14, 2016 the contents of all of which are herein fully incorporated by reference in its entirety.

FIELD OF THE EMBODIMENTS

The present invention relates to the technical field of sanitary ware, especially a pumping drainage device for toilet, which to implementing reinforced sewage removing for toilet.

BACKGROUND OF THE EMBODIMENTS

The method of discharging pollution for toilet with siphon principle has been widely used, by releasing the water in the water tank, which passes through the communicating vessels, siphonage produces under the action of atmospheric pressure, so as to strengthen blowdown effect. However, enough water is required for completing siphonage. To reduce water consumption, patent No. CN101649640A has disclosed "a pumping drainage device", arranging a piston tube at the end of the siphon of the toilet, with the piston movement in the piston tube, negative pressure is formed at the end of the siphon, enabling the water in the pipeline to be siphoned rapidly, achieving the purpose of saving water and sewage removing. Due to that the size, mounting position and operational space of a toilet are limited, while the operating strokes of both the piston and cylinder liner are excessive, to enable the piston head to complete a whole working procedure (moving from the top dead center to the bottom dead center), a complicated shifter fork component drag-link mechanism is adopted, giving rise to complicated structure, difficult operation, unclean pumping, low efficiency and other defects, therefore, restricting the popularization and application of the technology of "a pumping drainage device."

SUMMARY OF THE EMBODIMENTS

The invention intends to solve the deficiencies of the existing technology, so as to provide a pumping drainage device for toilets. This device adopts two-stage movement of piston and cylinder liner, which greatly reduces the stroke of the piston with the efficacy unchanged, decreases the boundary dimension and effectively controls the pumping speed that approaches to the water flushing speed, enabling the end face of the piston cylinder to fit the end face of the toilet and keep airtight, fast and simple to separate, which is compact in structure and easy to operate, with good pumping effect.

The technical scheme for realizing the purpose of the invention is: a pumping drainage device of the toilet, comprising: a cylindrical shell, arranged with a sewage draining outlet in the axial direction, and a sewer in the radial direction; a stepped cylindrical cylinder cover, which is connected to the shell axially, arranged with a piston rod guide sleeve and two guide cylinder in the axial direction, and the outer wall of the piston rod guide sleeve is arranged with a locking groove; a cylindrical cylinder liner, arranged with a central locking sleeve seat in the axial direction, and a spring seat guide sleeve on both sides, sheathed in the cylinder cover, and the locking sleeve seat is arranged with a guide hole and a lock tongue hinge seat, and the end of the spring seat guide sleeve is arranged with an inner edge; a piston, arranged with a piston rod and two spring guide seats in the axial direction, which is arranged in the cylinder liner, and the end of the spring guide seat is arranged with an outer edge; a lock tongue component, which is arranged in the locking sleeve seat of the cylinder liner.

Preferably, the lock tongue component is composed of a lock tongue, a locking sleeve, a cover plate and a third spring; the locking sleeve is a cylindrical body, inner wall of the cylindrical body is arranged with a groove, one end of the outer wall is arranged with a spring seat, and the other end is arranged with a guide slide; the lock tongue is hinged to the lock tongue hinge seat of the cylinder liner, the locking sleeve is arranged in the locking sleeve seat, the cover plate is sheathed on the guide slide side of the locking sleeve and connected with the locking sleeve seat, and the third spring is arranged between the spring seat and locking sleeve seat of the locking sleeve.

Preferably, as to the piston arranged in the cylinder liner, the piston rod and two spring guide seats are respectively docked in the piston rod guide sleeve of the cylinder cover and two spring seat guide sleeve of the cylinder liner, and the axle center of the piston rod is arranged with a draw cord, which is led out by the piston rod guide sleeve of the cylinder cover.

Preferably, a first spring is arranged between the spring seat guide sleeve of the cylinder liner and the spring guide seat of the piston.

Preferably, a second spring is arranged between the piston rod guide sleeve of the cylinder cover and the rod of the piston.

A pumping drainage device, comprising: a cylindrical shell, arranged with a sewage draining outlet in the axial direction, and a sewer in the radial direction; a cylindrical cylinder cover, which covers the other end of the cylindrical shell coaxially, away from the end that is arranged with the sewage draining outlet, and forms an accommodating space with the cylindrical cylinder cover; a piston rod guide sleeve and a guide cylinder are arranged in the cylindrical cylinder cover axially; a cylindrical cylinder liner, which is arranged in the accommodating space coaxially; one end of the cylindrical cylinder liner abuts against the end face where the sewage draining outlet of the cylindrical shell is located; meanwhile, the side wall of the cylindrical cylinder liner encloses the sewer; the other end of the cylindrical cylinder liner is arranged with a locking sleeve seat sheathed on the piston rod guide sleeve and a spring seat guide sleeve extruding into the guide cylinder; a lock-unlock device is arranged between the locking sleeve seat and the piston rod guide sleeve; a piston, which is arranged in the cylindrical cylinder liner coaxially, with one end abutting against the end face of the sewage draining outlet of the cylindrical shell; the other end of the piston is arranged with a piston rod extruding into the piston rod guide sleeve, and the spring guide seat extruding into the spring seat guide sleeve; a first spring is arranged between the spring guide seat and the spring seat guide sleeve, and a second spring is arranged between the piston and the piston rod guide sleeve; the piston moves axially and opens the sewage draining outlet firstly, then the piston continues to move and trigger the lock-unlock device, enabling make the locking sleeve seat to unlock with the piston rod guide sleeve, the cylindrical cylinder liner is unlock with the cylindrical cylinder cover, thus enabling the cylindrical cylinder liner to move and open the sewer, and enabling the sewage draining outlet to communicates with the sewer.

Preferably, the end of the spring seat guide extruding into the spring seat guide sleeve is arranged with an outer edge, the end where the spring seat guide sleeve is connected with the spring guide seat is arranged with an inner edge, the outer edge cooperates with the inner edge, to avoid the spring guide seat disengaging from the spring seat guide sleeve, and the spring guide seat moves axially along the inner wall of the spring seat guide sleeve.

Preferably, a sliding sleeve is arranged between the spring seat guide sleeve and the spring guide seat coaxially, and both ends of the sliding sleeve are respectively connected to the spring seat guide sleeve and the spring guide seat in a scalable way.

Preferably, the lock-unlock device comprises a locking sleeve seat, a lock tongue, a locking sleeve, a cover plate and a third spring; an annular groove is arranged in the circle of the side wall of the locking sleeve seat annular groove; the locking sleeve is arranged in the annular groove, and slidable along the inner wall of the annular groove; the cover plate is arranged at the end face of the notch at the right end of the annular groove, so as to avoid the locking sleeve disengaging from the annular groove; one end of the locking sleeve is arranged with a spring seat, and a third spring is arranged between the spring seat and the annular groove axially; the other end of the locking sleeve is arranged with a guide slide, and the guide slide extrudes out of the cover plate; the inner wall of the locking sleeve seat is arranged with a mounting hole, a lock tongue hinged seat is arranged in the mounting hole, the lock tongue is installed on the lock tongue hinged seat; a groove is arranged at the inner wall of the locking sleeve facing the lock tongue, a lock slot is arranged at the position corresponding to the lock tongue, on the lateral wall of the piston rod guide sleeve.

Preferably, the axle center of the piston rod is connected with a draw cord, and the draw cord is led out from the piston rod guide sleeve.

A pumping drainage device, further comprising: an overflow locking mechanism, comprising an overflow sucker, arranged at the end where the cylindrical cylinder liner abuts against the inner wall end face of the cylindrical shell by a fixed part; an adjustable exhaust air mechanism, comprising an exhaust air regulating valve and a valve seat, one end of the exhaust air regulating valve is open and becomes an exhaust air slot, and the exhaust air regulating valve is arranged with several exhaust vents; the other end of the cylindrical cylinder liner is arranged with a piston cylinder cover, the valve seat is arranged at the piston cylinder cover, and the exhaust air regulating valve moves as pushed by the piston.

Preferably, the shape of the exhaust air regulating valve is a hollow cylinder with a bottom, hollow part forms a third air vent, the bottom of the exhaust air regulating valve is arranged with a second air vent, a first air vent is arranged at the cylinder wall, the other end of the second air vent is arranged with an exhaust air slot, the exhaust air regulating valve is arranged in the valve seat, and moves in the valve seat.

Preferably, when the piston conducts pumping, the first exhaust vent being in a closed state in the valve seat, the gas in the cylindrical cylinder liner can only be discharged from the third exhaust vent through the second exhaust vent; when the piston moves to contact the exhaust air regulating valve, the piston pushes the exhaust air regulating valve, enabling the first exhaust vent of the exhaust air regulating valve to eject from the end face of the piston cylinder cover, since the end face of the piston fits the end face of the exhaust air regulating valve, the gas in the cavity of the cylindrical cylinder liner is discharged from the air-exhaust slot via the third exhaust vent through the first exhaust vent and second exhaust vent in the meantime, accelerating the exhaust velocity.

Preferably, the fixed part is a sucker clamp ring fixing the overflow sucker to the periphery of the cylindrical cylinder liner, when the bottom of the cylindrical cylinder liner abuts against the inner wall end face of the cylindrical shell, the edge of the overflow sucker extending out will tightly fit the inner wall end face of the shell seat.

Preferably, the overflow sucker is a soft elastic material comprising rubber.

Compared with the existing technology, the superiorities and positive effects of the invention by adopting the above technical proposal are as follows:

The invention adopts two-stage movement of piston and cylinder liner, controlled by the lock tongue component, with the automatic reset function, which greatly reduces the stroke of the piston with the efficacy unchanged, decreases the boundary dimension and effectively controls the pumping speed that approaches the water flushing speed, enabling the end face of the piston cylinder to fit the end face of the end of the toilet and keep airtight, fast and simple to separate, with compact structure, easy operation and good pumping effect.

BRIEF DESCRIPTION OF THE DRAWINGS

According to the figures, the above-mentioned and other characteristics and advantages of the present invention can be understood more clearly through the following descriptions, wherein.

DESCRIPTION OF THE PREFERRED EMBODIMENTS

By reference to the figures herein, below is the description of the present invention in more detail. Nevertheless, the invention can be realized in different forms, and shall not be interpreted as restricted by the embodiments proposed hereof. On the contrary, these embodiments are proposed for achieving the purpose of sufficient and complete disclosure, as well as enabling technicians of this technical field to fully understand the scope of the invention. For clearness, the size and relative size of the layers and areas in these figures may be magnified.

Embodiment 1

Figure 1:
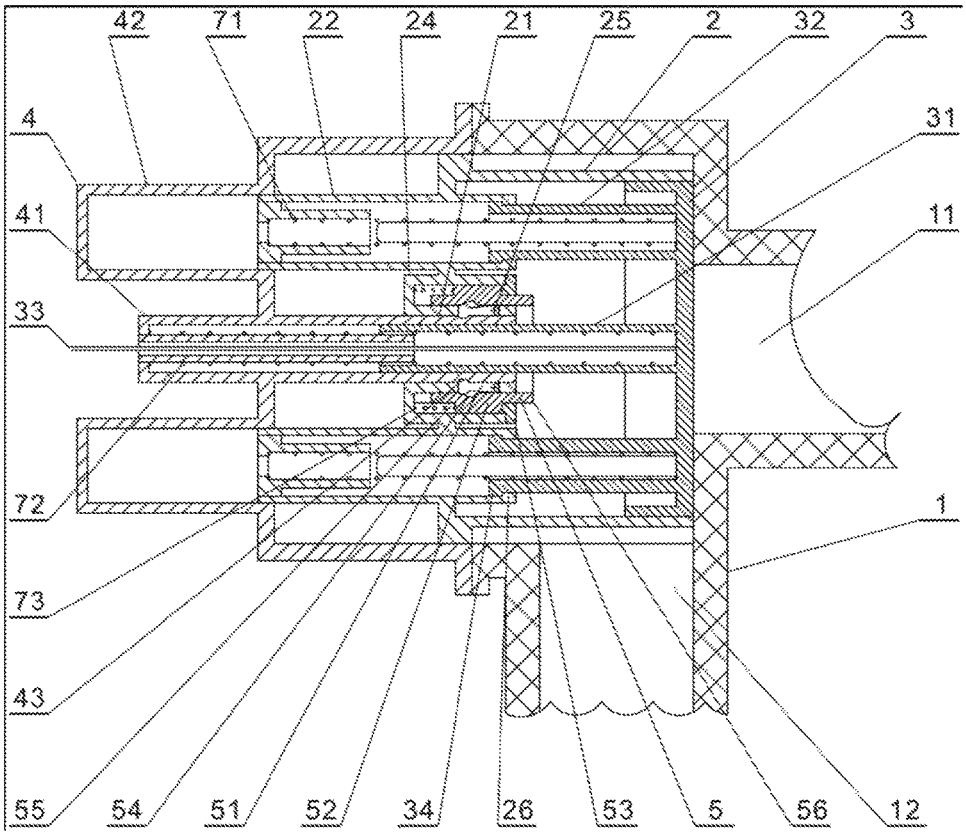
FIG. 1 is a structure diagram of the invention in Embodiment 1 and Embodiment 2.

Please refer to FIG. 1, this invention includes: A cylindrical shell 1, arranged with a sewage draining outlet 11 in the axial direction, and a sewer 12 in the radial direction;

A stepped cylindrical cylinder cover 4, arranged with a piston rod guide sleeve 41 and two guide cylinders 42 in the axial direction, which is connected to the cylindrical shell 1 axially, and the outer wall of the piston rod guide sleeve 41 is arranged with a locking groove 43;

A cylindrical cylinder liner 2, arranged with a central locking sleeve seat 24 in the axial direction, and a spring seat guide sleeve 22 on both sides, sheathed in the stepped cylindrical cylinder cover 4, and the central locking sleeve seat 24 is arranged with a guide hole 21 and a lock tongue hinge seat 25, and the end of the spring seat guide sleeve 22 is arranged with an inner edge 26;

A piston 3, arranged with a piston rod 31 and two spring guide seats 32 in the axial direction, which is arranged in the cylinder liner 2, and the end of the spring guide seat is arranged with an outer edge 34;

A lock tongue component 5, which is arranged in the central locking sleeve seat 24 of the cylinder liner 2.

The lock tongue component 5 comprises a lock tongue 51, a locking sleeve 52, a cover plate 53 and a third spring 73; the locking sleeve 52 is a cylindrical body, the inner wall of the locking sleeve arranged with a groove 54, one end of the outer wall is arranged with a spring seat 55, and the other end is arranged with a guide slide 56; the lock tongue 51 is hinged to the lock tongue hinge seat 25 of the cylinder liner 2, the locking sleeve 52 is arranged in the central locking sleeve seat 24, the cover plate 53 is sheathed on the end of the guide slide 56 of the locking sleeve 52 and connected with the central locking sleeve seat 24, and the third spring 73 is arranged between the spring seat 55 and the central locking sleeve seat t 24 of the locking sleeve 52;

As to the piston 3 arranged in the cylinder liner 2, the piston rod 31 and two spring guide seats 32 are respectively docked in the piston rod guide sleeve 41 of the cylinder cover 4 and two spring seat guide sleeves 22 of the cylinder liner 2; and the axle center of the piston rod 31 is arranged with a draw cord 33, which is led out by the piston rod guide sleeve 41 of the cylinder cover 4;

A first spring 71 is arranged between the spring seat guide sleeve 22 of the cylinder liner 2 and the spring guide seat 32 of the piston;

A second spring 72 is arranged between the piston rod guide sleeve 41 of the cylinder cover 4 and the piston rod 31 of the piston 3.

The invention is used in the way described below:

Please refer to FIG. 1, install the invention to the end of the siphon of the toilet, enabling the end of shell 1 with a sewage draining outlet 11 to connect with the siphon, and the sewer 12 to connect with the sewer pipe; and connect the draw cord 33 of the piston 3 to the flush handle of the toilet. The flushing process is:

Twist the flush handle, when the flashing valve of the water tank is opened, the draw cord 33 moves accordingly, driving the piston 3 to overcome the resistance of the first spring 71 and the second spring 72 and move to the left in the cylinder liner 2, at this moment, negative pressure is formed in the cylinder liner 2 at the end of the siphon of the toilet, enabling the water in the pipeline to be siphoned rapidly; when the end face of the piston 3 contacts the locking sleeve 52 of the lock tongue component 5, the piston 3 and the locking sleeve 52 will overcome the resistance of the third spring 73 and continue to move leftwards; the locking sleeve 52 moves leftwards in the cover plate 53 through the guide slide 56, the groove 54 of the locking sleeve 52 shifts, enabling the lock tongue 51 to ejected from the locking groove 43 of the cylinder cover 4, the cylinder liner 2 is unlocked with cylinder cover 4, the end face of the piston 3 resists against the piston rod guide sleeve 41 and stops moving, and the elastic force of the first spring 71 is released; the cylinder liner 2 moves leftwards under the elasticity of the spring 71, at this moment, the guide hole 21 of the central locking sleeve seat 24 on the cylinder liner 2 and the spring seat guide sleeve 22 on both sides slide on the piston rod guide sleeve 41 of cylinder cover 4 and in the two guide cylinders 42 respectively, the cylinder liner 2 is gradually disengaged from the inner end face of the shell 1, until the sewage draining outlet 11 is fully opened, the sewage draining outlet 11 is communicates with the sewer 12, enabling the sewage to discharge from the sewer 12, and the flushing operation is completed;

The reset process: when the water in the water tank is fully discharged, loosen the draw cord 33, the flashing valve will close automatically, and the flush handle will reset on its own; under the elasticity of the first spring 71 and the second spring 72, piston 3 moves rightwards in the cylinder liner 2; when the outer edges 34 of the spring guide seat 32 are clamped to the inner edges 26 of the spring seat guide sleeve 22 of the cylinder liner 2, under the continual action of the second spring 72, the piston 3 drives the cylinder liner 2 to move rightwards; when the cylinder liner 2 and the piston 3 move to fit the end face of shell 1, the sewage draining outlet 11 is closed and the drainage channel 12 is closed, the lock tongue 51 hinged to the lock tongue hinged seat 25 of cylinder liner 2 reaches the position of the locking groove 43 of the cylinder cover 4; as the piston 3 moves to the right, the piston 3 has released the compression on the locking sleeve 52, under the action of the third spring 73, the locking sleeve 52 moves rightwards in the cover plate 53 through the guide slide, the lock tongue 51 is oppressed by the locking sleeve 52, retreats from the groove 54 of the locking sleeve 52 and is clamped to the locking groove 43 of the cylinder cover 4 again, deadlocking the cylinder liner 2 and the cylinder cover 4, and the reset operation is completed.

Embodiment 2

Please refer to FIG. 1, the invention provides a pumping drainage device, comprising a cylindrical shell 1, a cylindrical cylinder cover 4 and a piston cylinder, and the piston cylinder comprises a cylindrical cylinder liner 2 and a piston 3.

The cylindrical shell 1 presents the cylindrical structure, the left end of the cylindrical structure is open, the right end face in the axial direction is arranged with a sewage draining outlet 11, and the radial wall is arranged with a sewer 12 in the radial direction.

The cylindrical cylinder cover 4 presents a cylindrical structure, the right end of the cylindrical structure is open, the right end of the cylindrical cylinder cover 4 is open and covers the cylindrical shell (namely, the other end of the cylindrical shell, that is away from the end arranged with the sewage draining outlet) coaxially, and the cylindrical cylinder cover 4 forms an accommodating space with the cylindrical shell 1.

The cylindrical cylinder cover 4 is arranged with a piston rod guide sleeve 41 and guide cylinder 42 in the axial direction; the piston rod guide sleeve 41 is arranged in the center of the cylindrical cylinder cover 4; two guide cylinders 42, which are symmetrically arranged relative to the piston rod guide sleeve 41 are arranged in the cylindrical cylinder cover 4; therein, the number of the guide cylinder 42 can be 3 or 4 or more and the number of the guide cylinder 42 is not limited hereof, and can be adjusted according to the specific circumstances; therein, the piston rod guide sleeve 41, the guide cylinder 42 can be integrally formed with the cylindrical cylinder.

The cylindrical cylinder liner 2 is placed coaxially in the accommodating space formed by the cylindrical shell 1 and the cylindrical cylinder cover 4; one end of the cylindrical cylinder liner 2 abuts against the end face where the sewage draining outlet 11 of the cylindrical shell 1 is located, enabling the sewage draining outlet 11 to connect with the interior of the cylindrical cylinder liner 2; meanwhile, the side wall of the cylindrical cylinder liner 2 encloses the sewer 12; the other end of the cylindrical cylinder liner 2 is arranged with a central locking sleeve seat 24 sheathed on the piston rod guide sleeve 41 and the spring seat guide sleeve 22 extruding into the guide cylinder 42, and the central locking sleeve seat 24 can move axially along the lateral wall of the piston rod guide sleeve 41, and the spring seat guide sleeve 22 can move axially along the medial wall of the guide cylinder 42. Wherein, the central locking sleeve seat 24 and the spring seat guide sleeve 22 can be integrally formed with the cylindrical cylinder liner 2.

The piston 3 is placed in the cylindrical cylinder liner 2 coaxially, and one end of the piston 3 abuts against the end face where the sewage draining outlet 11 on the cylindrical shell 1 is located, the piston 3 encloses the sewage draining outlet 11; the other end of the piston 3 is arranged with a piston rod 31 extruding into the piston rod guide sleeve 41, and the spring guide seat 32 extruding into the spring seat guide sleeve 22; the piston rod 31 can move axially along the medial wall of the piston rod guide sleeve 41, and the spring guide seat 32 can move axially along the medial wall of the spring seat guide sleeve 22.

Further, a first spring 71 is arranged between the spring guide seat 32 and the spring seat guide sleeve 22, and a second spring 72 is arranged between the piston rod 31 and the piston rod guide sleeve 41. When the piston 3 moves leftwards, the piston rod 31 moves leftwards along the piston rod guide sleeve 41 and compress the second spring 72, the spring guide seat 32 move leftwards along the spring seat guide sleeve 22 and compresses the first spring 71.

Further, the end of the spring guide seat 32 extruding into the spring seat guide sleeve 22 is arranged with an outer edge 34, the end where the spring seat guide sleeve 22 is connected to the spring guide seat 32 is arranged with an inner edge 26, the outer edge 34 cooperates with the inner edge 26, to avoid the spring guide seat 32 disengaging from the spring seat guide sleeve 22 in the moving process, realizing scalable connection.

A lock-unlock device is further arranged between the central locking sleeve seat 24 and the piston rod guide sleeve 41, and the lock-unlock device comprises a locking sleeve seat, a lock tongue 51, a locking sleeve 52, a cover plate 53 and a third spring 73.

Specifically, an annular groove is arranged in the circle of the side wall of the central locking sleeve seat 24; the locking sleeve 52 is a cylindrical body and is placed in the annular groove, the locking sleeve 52 can slide axially along the inner wall of the annular groove; the cover plate 53 covers the end face of the notch at the right end of the annular groove, to avoid the locking sleeve 52 disengaging from the annular groove; one end of the locking sleeve 52 is arranged with a spring seat 55, and a third spring 73 is arranged between the spring seat 55 and the annular groove axially; the other end of the locking sleeve 52 is arranged with a guide slide 56, and the guide slide 56 extrudes out of the cover plate 53; the inner wall of the central locking sleeve seat 24 is arranged with a mounting hole, a lock tongue hinged seat 25 is arranged in the mounting hole, and the lock tongue 51 is installed on the lock tongue hinged seat 25; the inner wall of the lock sleeve 52 is arranged with a groove 54, and a locking groove 43 is arranged at the position where the lateral wall of the piston rod guide sleeve 41 corresponds to the position of the lock tongue 51.

The axle center of the piston rod 31 is further connected with a draw cord 33, which is led out by the piston rod guide sleeve 41.

A further explanation of the operating principles is described below:

Before sewage removing, one end of the cylindrical cylinder liner 2 abuts against the end face of the cylindrical shell which is arranged with the sewage draining outlet 11, the end face of piston 3 encloses the sewage draining outlet 11, the side wall of the cylindrical cylinder liner 2 encloses the sewer 12 (even if the sewage draining outlet llis disconnected from the sewer 12); when the sewage removing is required, pulling the draw cord 33 leftwards, the draw cord 33 will drive the piston 3 to overcome the resistance of the first spring 71 and the second spring 72, and move leftwards in the cylinder liner 2, at this moment, negative pressure is then formed in the cylindrical cylinder liner 2 at the right end of the piston, enabling the water in the sewage draining outlet to enter the cylindrical cylinder liner 2;

The piston 3 continues to move towards the left; when the left end face of the piston 3 contacts the end face of the guide slide 56, the piston 3 and the locking sleeve 52 will overcome the resistance of the third spring 73 and continue to move leftwards; when the groove 54 on the locking sleeve 52 moves to the position of the lock tongue 51, the lock tongue 51 ejected from the locking groove 43 of the cylindrical cylinder cover 4, the central locking sleeve seat 24 is unlocked with the piston rod guide sleeve 41, then the cylindrical cylinder liner 2 is unlocked with the cylindrical cylinder cover 4, at this moment, the end face of the piston 3 abuts against the piston rod guide sleeve 41 and stops moving, and the elastic force of the first spring 71 is released; the cylindrical cylinder liner 2 moves leftwards under the elastic of the spring 71, the guide hole 21 of the central locking sleeve seat 24 on the cylindrical cylinder liner 2 and the spring seat guide sleeve 22 on both sides slide on the piston rod guide sleeve 41 of the cylinder cover 4 and in the two guide cylinders 42 respectively; the cylindrical cylinder liner 2 moves leftwards and open the sewer gradually, enabling the sewage draining outlet 11 to communicates with the sewer 12, to discharge the sewage from the sewer 12, and the flushing operation is completed;

When the sewage removing is discharge, loosen the draw cord 33, the piston 3 moves rightwards in the cylindrical cylinder liner 2 under the action of the first spring 71 and the second spring 72; when the outer edges 34 of the spring guide seat 32 are clamped to the inner edges 26 of the spring seat guide sleeve 22 of the cylindrical cylinder liner 2, under the continual action of the second spring 72, the piston 3 drives the cylindrical cylinder liner 2 to move rightwards; when the cylindrical cylinder liner 2 and the piston 3 move to fit the end face of the cylindrical shell 1, the sewage draining outlet 11 is closed and the sewer 12 is closed, the lock tongue 51 hinged to the lock tongue hinged seat 25 of the cylinder liner 2 reaches the position of the locking groove 43 of the cylindrical cylinder cover 4; as the piston 3 moves to the right, the piston 3 has released the compression on the locking sleeve 52, under the action of the third spring 73, the locking sleeve 52 moves rightwards in the cover plate 53 through the guide slide 56, the lock tongue 51 is oppressed by the locking sleeve 52, retreats from the groove 54 of the locking sleeve 52 and is clamped to the locking groove 43 of the cylindrical cylinder cover 4 again, deadlocking the cylindrical cylinder liner 2 and the cylindrical cylinder cover 4, and the reset operation is completed.

Embodiment 3

Figure 2:
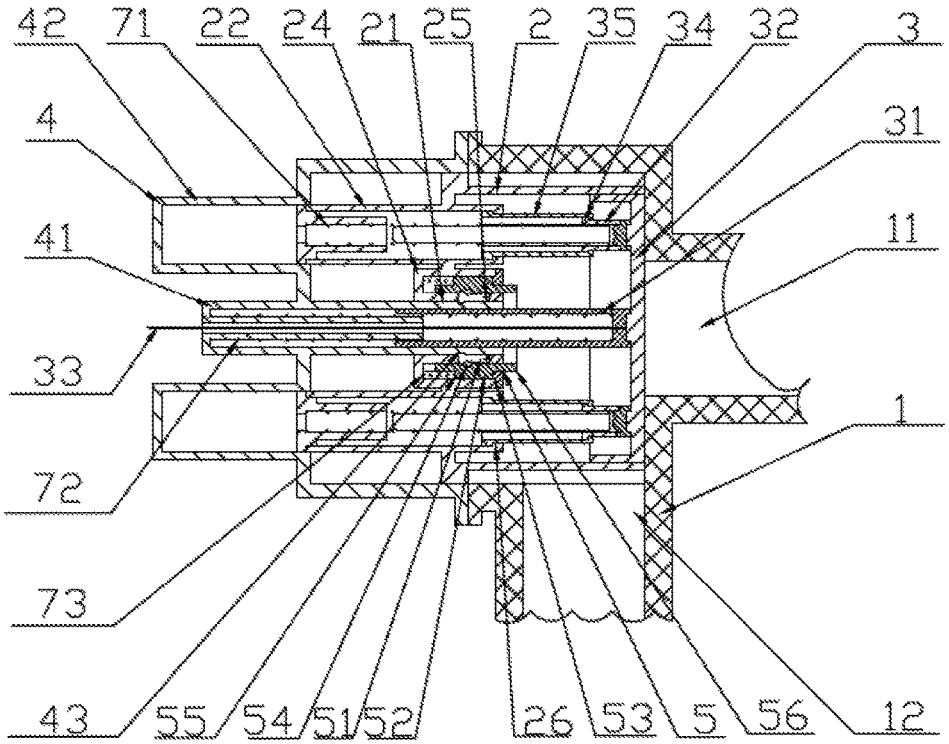
FIG. 2 is a structure diagram of the invention in Embodiment 3.

Please refer to FIG. 2, this embodiment is an improvement based on Embodiment 1 or 2. In this embodiment, a sliding sleeve 35 is further arranged between the spring seat guide sleeve and the spring guide seat coaxially, and both ends of the sliding sleeve 35 are respectively connected to the spring seat guide sleeve and the spring guide seat in a scalable way. In this embodiment, the stroke of the piston is further reduced by arranging the sliding sleeve 35 so as to further reduce the boundary dimension; of course, two or more sliding sleeves can also be arranged in other embodiments, which will not be restricted hereof.

Embodiment 4

Figure 3:
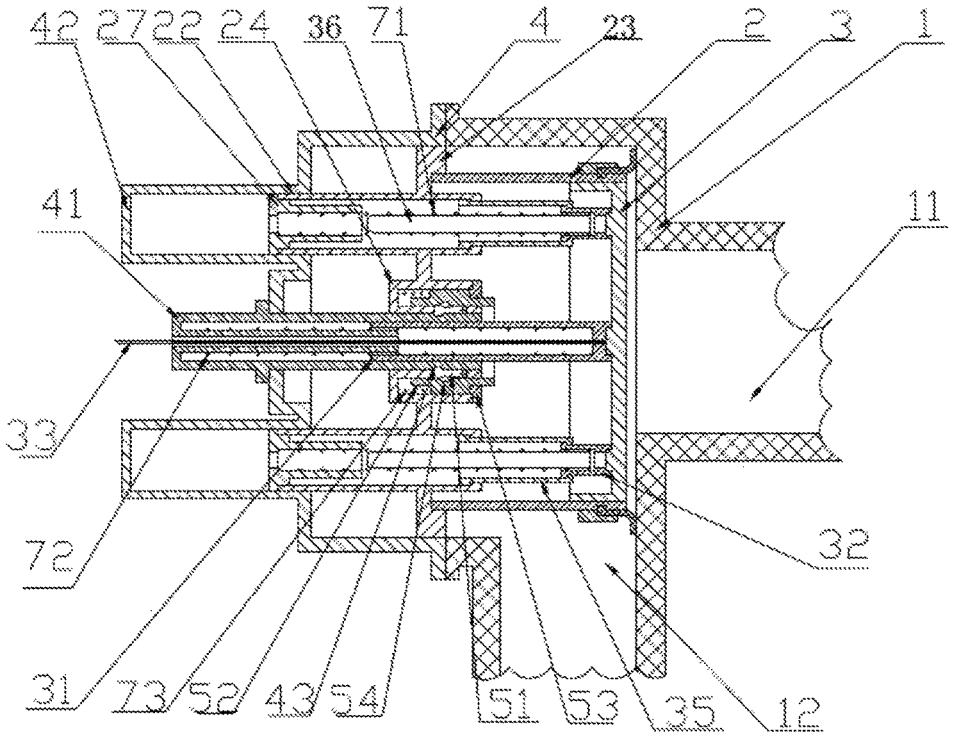
FIG. 3 is a structure diagram of the overflow sucked type adjustable evacuative pumping drainage device in Embodiment 4.

Please refer to FIG. 3-5, this embodiment is an improvement based on Embodiment 1, or Embodiment 2 or Embodiment 3, and it is presented in details as follows:

An overflow locking mechanism 6 is arranged at the place where the bottom of the cylindrical cylinder liner 2 contacts the end face of the inner wall of the cylindrical shell 1. A sucker clamp ring 61 as shown in the figure of this locking mechanism 6 fixes the overflow sucker 62 with the cylindrical cylinder liner 2 to be one piece.

Figure 5:
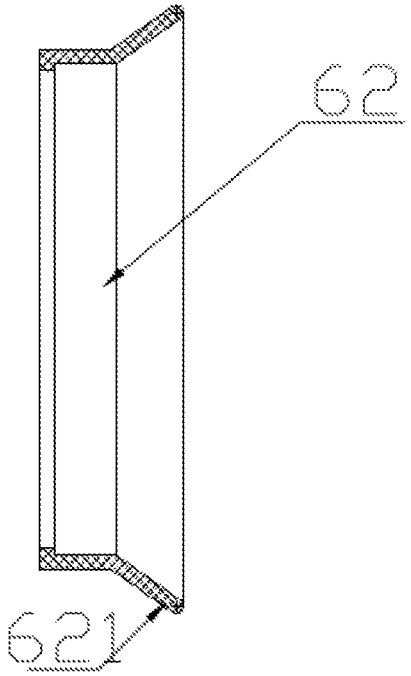
FIG. 5 is a magnified diagram of the overflow sucker in FIG. 4.

Please refer further to FIG. 5. The overflow sucker 62 in the invention is a soft elastic material; when the edge 621 of the overflow sucker 62 fits the end face of the inner wall of the cylindrical shell 1, and the intensity of pressure in the cylindrical cylinder liner 2 and the cavity of the sewage draining outlet 11 of the toilet is greater than the outside atmospheric pressure, the water in the sewage draining outlet 11 will push away the joint surface between the edge 621 of the overflow sucker 62 and the inner wall end face of the cylindrical shell 1, enabling the water in the sewage draining outlet 11 to overflow from the pushed gap; when the piston 3 pumping, and negative pressure is formed in the cylindrical cylinder liner 2 and the cavity of the toilet sewage draining outlet 11, the edge 621 of the overflow sucker 62 will fit tightly with the end face of the inner wall of the cylindrical shell 1, the greater the pressure difference is, the more tight will they fit. In this way, airtight fitting between the end face of the cylindrical cylinder liner 2 and the inner wall end face of the cylindrical shell 1 is ensured during the piston 3 being pumping.

On the other hand, in order to solve the convenience of the separation between the end face of the cylindrical cylinder liner and the inner wall end face of the cylindrical shell 1, in this embodiment, an adjustable air-releasing mechanism is arranged on the piston cylinder cover 23 which is covered on the other end of the cylindrical cylinder liner 2.

Figure 4:
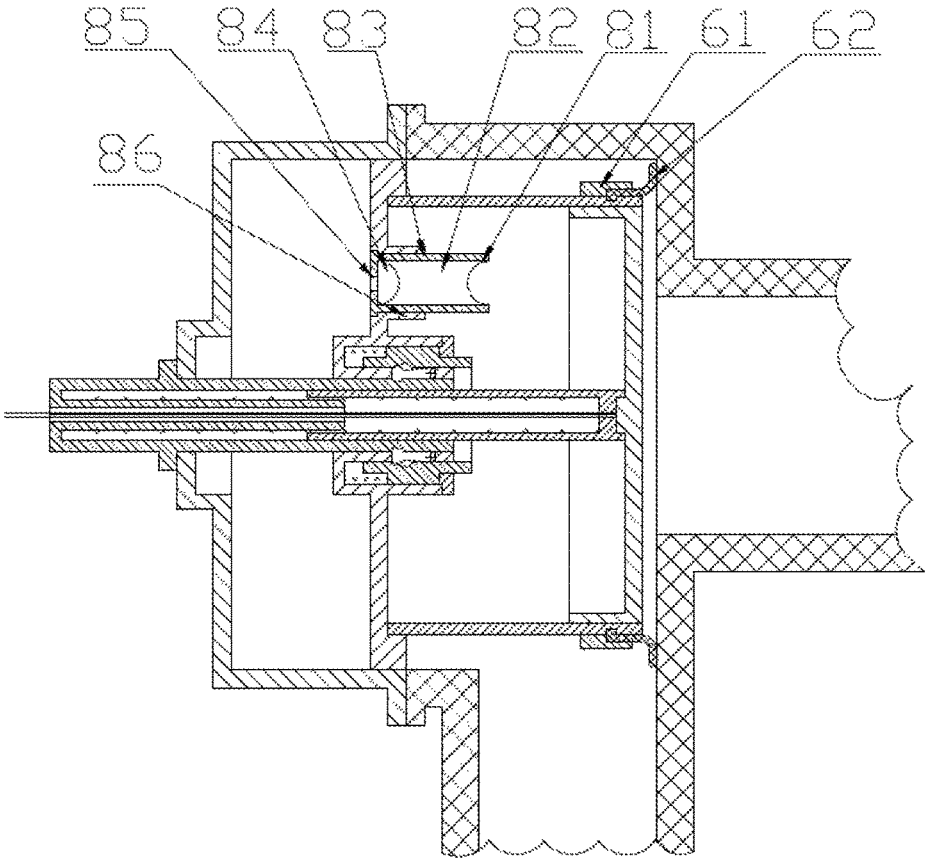
FIG. 4 is a partial magnified diagram in FIG. 3.

Please refer to FIG. 4. This adjustable air-releasing mechanism comprises an exhaust air regulating valve 83 and a valve seat 86; the shape of the exhaust air regulating valve 83 is a hollow cylinder with a bottom, the hollow part forms a third air vent 82, the bottom of the end of the exhaust air regulating valve 83 with a bottom is arranged with a second air vent 85, a first air vent 84 is arranged on both sides of the cylinder wall near the bottom end, the other end face of the cylinder of the exhaust air regulating valve 83 is arranged with an exhaust air slot 81, the valve seat 86 is arranged on the piston cylinder cover 23; one end of the exhaust air regulating valve 83 passes through and is arranged in the valve seat 86, and can move in the valve seat 86.

When external force is set, the movement speed of the piston 3 can be controlled by the exhaust air regulating valve 83. The working process of the sliding exhaust air regulating valve 83 is as follows: when the piston 3 pumping, the first exhaust vent 84 is in the closed state in the valve seat 86, the gas in the cylindrical cylinder liner 2 can only be discharged from the third exhaust vent 82 through the second exhaust vent 85, enabling the movement speed of the piston 3 to be slow; when the piston 3 moves to contact the exhaust air regulating valve 83, the piston 3 starts to push the exhaust air regulating valve 83, enabling the exhaust air regulating valve 83 to move leftwards, until the first exhaust vent 84 of the exhaust air regulating valve 83 emerges from the end face of the piston cylinder cover 23; as the end face of the piston 3 fits the end face of the exhaust air regulating valve 83, the gas in the cavity of the cylindrical cylinder liner 2 is discharged from the air-exhaust slot 81 via the third exhaust vent 82 through the first exhaust vent 84 and the second exhaust vent 85 in the meantime, increased the exhaust speed; when the cylindrical cylinder liner 2 is unlocked with the cylindrical cylinder cover 4, the cylindrical cylinder liner 2 can quickly discharge from the inner wall end face of the cylindrical shell 1, achieving the effect of rapid sewage removing.

The whole working process of the pumping drainage device is further described in detailed with FIG. 3*in* the following.

The flushing stage:

Pulling the draw cord 33, and the piston 3 starts to pumping, since the negative pressure is produced in the cylindrical cylinder liner 2 and the cavity of the sewage draining outlet 11, the edge 621 of the overflow sucker enables the edge 621 to keep airtight with the end face of the inner wall of the cylindrical shell 1 due to the negative pressure in the cavity, meanwhile, the spring guide seat 32 on the piston 3 compress the first spring 71 to move leftwards in the sliding sleeve 35, and the piston rod 31 compresses the second spring 72 to move leftwards in the piston rod guide sleeve 41 and moves to the end face of the piston 3 when it contacts the sliding sleeve 35, the piston 3 pushes the sliding sleeve 35 to move together leftwards, meanwhile, the sliding sleeve 35 move leftwards in the spring seat guide sleeve 22, the spring spindles 36 move leftwards and pass through the spring seat guide sleeve cover 27, when the piston 3 moves and contacts the exhaust air regulating valve 83, the piston 3 pushes the exhaust air regulating valve 83 to move leftwards, the exhaust air regulating valve 83 moves leftwards in the valve seat 86 on the piston cylinder cover 23, when moving to the position where the end face of the piston 3 contacts the locking sleeve 52, the piston 3 will then push the locking sleeve 52 and compress the third spring 73 to continue to move leftwards, the locking sleeve 52 moves leftwards in the central locking sleeve seat 24 and the cover plate 53 at this moment, when the piston 3 moves to the limiting position of the end face of the piston rod guide sleeve 41, the piston 3 stops moving, the first exhaust vent 84 of the exhaust air regulating valve 83 emerges from the end face of the piston cylinder cover 23, the groove 54 of the locking sleeve 52 also moves to the position of the lock tongue 51, enabling the lock tongue 51 to disengage from the locking groove 43 of the piston rod guide sleeve 41, and the central locking sleeve seat 24 is unlocked with the piston rod guide sleeve 41; under the action of the first spring 71, the central locking sleeve seat 24, piston cylinder cover 23 and cylindrical cylinder liner 2 are made to move leftwards along the piston rod guide sleeve 41, meanwhile, the spring seat guide sleeve 22 move leftwards in the guide cylinder 42, since the first exhaust vent 84 of the exhaust air regulating valve 83 emerges from the end face of the piston cylinder cover 23, the gas displacement in the cylindrical cylinder liner 2 increases, the cylindrical cylinder liner 2 drives the overflow sucker 62 and the sucker clamp ring 61 to disengage from the end face of the inner wall of the cylindrical shell 1, enabling the sewage draining outlet 11 to communicates with the sewer 12, the siphoned sewage in the sewage draining outlet 11 and the sewage in the cylindrical cylinder liner 2 are discharged to the sewer 12 together, meanwhile, the cylindrical cylinder liner 2 drives the overflow sucker 62 and the sucker clamp ring 61 to quickly disengage from the end face of the inner wall of the cylindrical shell 1, until the top of the piston cylinder cover 23 contacts the end face of the cylindrical cylinder cover 4, and the cylindrical cylinder cover 4 compresses the exhaust air regulating valve 83, enabling the first exhaust vent 84 to be pressed into the valve seat 86 on the piston cylinder cover 23.

The reset stage:

When the user loosens the draw cord 33, the piston 3 starts to move rightwards in the cylindrical cylinder liner 2 under the action of the first spring 71 and the second spring 72, the sliding sleeve 35 and the spring guide seat 32 move rightwards respectively in the spring seat guide sleeve 22 and the sliding sleeve 35, the piston rod 31 moves rightwards in the piston rod guide sleeve 41; since the piston 3 has disengaged from the locking sleeve 52 and released the third spring 73, when the piston 3 in the cylindrical cylinder liner 2 moves to the spring guide seat 32, buckles the sliding sleeve 35, and the sliding sleeve 35 buckles the spring seat guide sleeve 22, the first spring 71 will not act, while the second spring 72 will continue to act and drive the cylindrical cylinder liner 2, piston cylinder cover 23 and central locking sleeve seat 24 to move rightwards along the piston rod guide sleeve 41; when the central locking sleeve seat 24 moves to the position where the lock tongue 51 reaches the locking groove 43 on the piston rod guide sleeve 41, the locking sleeve 52 is pushed under the action of the third spring 73 and the lock tongue 51 is pressed into the locking groove 43, enabling the cylindrical cylinder liner 2 to lock deadly with the cylindrical cylinder cover 4, the edge 621 of the overflow sucker 62 fits perfectly with the inner wall end face of the cylindrical shell 1, and the reset operation is thus completed.

When the pumping drainage device provided by the embodiment is applied to a toilet, it is mounted to the end of the sewage draining outlet 11 of the toilet, enabling the end of the cylindrical shell 1 arranged with a sewage draining outlet 11 to connect with the toilet, and the sewer 12 to connect with the drain pipe; and the draw cord 33 of the piston 3 shall be connected with the flush handle of the toilet.

According to the above explanations, the invention has greatly improved the pumping effect of the pumping drainage device, and solved the problems that the end face of the cylindrical cylinder liner being not fully jointed with the end face of the cylindrical shell cannot be ensure, and the pumping speed of the piston can't be controlled to approach to the flushing speed of the toilet, enabling the pumping effect to greatly decrease, giving rise to the unclean pumping in the existing technology; thus, the application and popularization of the product are improved.

It should be understood by technicians in this technical field that the invention can be embodied in many other specific ways without prejudice to the spirit or scope of the present invention. Although the embodiments of the invention have been described, it should be understood that the present invention should not be limited to these embodiments and the technicians in the technical field may make changes and modifications to the spirit and scope of the invention as defined by the claims attached.

The invention claimed is:

1. A pumping drainage device is featured by, comprising:

a cylindrical shell, arranged with a sewage draining outlet in the axial direction, and a sewer in the radial direction;

a stepped cylindrical cylinder cover, which is connected to the shell axially, arranged with a piston rod guide sleeve and two guide cylinders in the axial direction, = and the outer wall of the piston rod guide sleeve is arranged with a locking groove;

a cylindrical cylinder liner, arranged with a central locking sleeve seat in the axial direction, and a spring seat guide sleeve on both sides, sheathed in the cylinder cover, and the locking sleeve seat is arranged with a guide hole and a lock tongue hinge seat, and the end of the spring seat guide sleeve is arranged with an inner edge;

a piston, arranged with a piston rod and two spring guide seats in the axial direction, which is arranged in the cylinder liner, and the end of the spring guide seat is arranged with an outer edge;

a lock tongue component, which is arranged in the locking sleeve seat of the cylinder liner.

2. The device of claim 1 wherein, the pumping drainage device is featured by, the lock tongue component comprises a lock tongue, a locking sleeve, a cover plate and a third spring; the locking sleeve is a cylindrical body, inner wall of the cylindrical body is arranged with a groove, one end of the outer wall is arranged with a spring seat, and the other end is arranged with a guide slide; the lock tongue is hinged to the lock tongue hinge seat of the cylinder liner, the locking sleeve is arranged in the locking sleeve seat, the cover plate is sheathed on the guide slide side of the locking sleeve, and the third spring is arranged between the spring seat and locking sleeve seat of the locking sleeve.

3. The device of claim 1 wherein, the pumping drainage device is featured by, as to the piston arranged in the cylinder liner, the piston rod and two spring guide seats are respectively docked in the piston rod guide sleeve of the cylinder cover and two spring seat guide sleeves of the cylinder liner, the axle center of the piston rod is arranged with a draw cord, which is led out by the piston rod guide sleeve of the cylinder cover.

4. The device of claim 1 wherein, the pumping drainage device is featured by, a first spring is arranged between the spring seat guide sleeve of the cylinder liner and the spring guide seat of the piston.

5. The device of claim 1 wherein, the pumping drainage device is featured by, a second spring is arranged between the piston rod guide sleeve of the cylinder cover and the piston rod of the piston.

6. A pumping drainage device is featured by, comprising:

a cylindrical shell, arranged with a sewage draining outlet in the axial direction, and a sewer in the radial direction;

a cylindrical cylinder cover, which covers the other end of the cylindrical shell coaxially, away from the end that is arranged with the sewage draining outlet, and forms an accommodating space with the cylindrical cylinder cover; a piston rod guide sleeve and a guide cylinder are arranged in the cylindrical cylinder cover axially;

a cylindrical cylinder liner, which is arranged in the accommodating space coaxially; one end of the cylindrical cylinder liner abuts against the end face where the sewage draining outlet of the cylindrical shell is located; meanwhile, the side wall of the cylindrical cylinder liner encloses the sewer; the other end of the cylindrical cylinder liner is arranged with a locking sleeve seat sheathed on the piston rod guide sleeve and a spring seat guide sleeve extruding into the guide cylinder; a lock-unlock device is arranged between the locking sleeve seat and the piston rod guide sleeve;

a piston, which is arranged in the cylindrical cylinder liner coaxially, with one end abutting against the end face of the sewage draining outlet of the cylindrical shell; the other end of the piston is arranged with a piston rod extruding into the piston rod guide sleeve, and the spring guide seat extruding into the spring seat guide sleeve; a first spring is arranged between the spring guide seat and the spring guide seat sleeve, and a second spring is arranged between the piston rod and the piston rod guide sleeve;

the piston moves axially and opens the sewage draining outlet firstly, then the piston continues to move and trigger the unlocking device, enabling make the locking sleeve seat to unlock with the piston rod guide sleeve, the cylindrical cylinder liner is unlock with the cylindrical cylinder cover, thus enabling the cylindrical cylinder liner to move and open the sewer, and enabling the sewage draining outlet to communicates with the sewer.

7. The device of claim 6 wherein, the pumping drainage device is featured by, the end of the spring guide seat extruding into the spring seat guide sleeve is arranged with an outer edge; the end where the spring seat guide sleeve is connected with the spring guide seat is arranged with an inner edge; the outer edge cooperates with the inner edge, to avoid the spring guide seat disengaging from the spring seat guide sleeve, and the spring guide seat moves axially along the inner wall of the spring seat guide sleeve.

8. The device of claim 7 wherein, the pumping drainage device is featured by, a sliding sleeve is arranged between the spring seat guide sleeve and the spring guide seat coaxially, and both ends of the sliding sleeve are respectively connected to the spring seat guide sleeve and the spring guide seat in a scalable way.

9. The device of claim 6 wherein, the pumping drainage device is featured by, the lock-unlock device comprises a locking sleeve seat, a lock tongue, a locking sleeve, a cover plate and a third spring;

an annular groove is arranged in the circle of the side wall of the locking sleeve seat; the locking sleeve is arranged in the annular groove, and slidable along the inner wall of the annular groove; the cover plate is arranged at the end face of the notch at the right end of the annular groove, so as to avoid the locking sleeve disengaging from the annular groove; one end of the locking sleeve is arranged with a spring seat, and a third spring is arranged between the spring seat and the annular groove axially; the other end of the locking sleeve is arranged with a guide slide, and the guide slide extrudes out of the cover plate;

the inner wall of the locking sleeve seat is arranged with a mounting hole, a lock tongue hinged seat is arranged in the mounting hole, the lock tongue is installed on the lock tongue hinged seat; a groove is arranged at the inner wall of the locking sleeve facing the lock tongue, a lock slot is arranged at the position corresponding to the lock tongue, on the lateral wall of the piston rod guide sleeve.

10. The device of claim 6, the pumping drainage device is featured by, the axle center of the piston rod is connected with a draw cord, and the draw cord is led out by the piston rod guide sleeve.

11. The device of claim 1 wherein, the pumping drainage device is featured by, further comprising:

an overflow locking mechanism, comprising an overflow sucker, arranged at the end where the cylindrical cylinder liner abuts against the inner wall end face of the cylindrical shell by a fixed part;

an adjustable exhaust air mechanism, comprising an exhaust air regulating valve and a valve seat, one end of the exhaust air regulating valve is open and becomes an exhaust air slot, and the exhaust air regulating valve is arranged with several exhaust vents; the other end of the cylindrical cylinder liner is arranged with a piston cylinder cover, the valve seat is arranged at the piston cylinder cover, and the exhaust air regulating valve moves as pushed by the piston.

12. The device of claim 11 wherein, the pumping drainage device is featured by, the shape of the exhaust air regulating valve is a hollow cylinder with a bottom, the hollow part forms a third air vent, the bottom of the exhaust air regulating valve is arranged with a second air vent, a first air vent is arranged at the cylinder wall, the other end of the second air vent is arranged with an exhaust air slot, the exhaust air regulating valve is arranged in the valve seat, and moves in the valve seat.

13. The device of claim 12 wherein, the pumping drainage device is featured by, when the piston pumping, the first exhaust vent being in a closed state in the valve seat, the gas in the cylindrical cylinder liner only be discharged from the third exhaust vent through the second exhaust vent, when the piston moves to contact the exhaust air regulating valve, the piston pushes the exhaust air regulating valve, enabling the first exhaust vent of the exhaust air regulating valve to eject from the end face of the piston cylinder cover; since the end face of the piston fits the end face of the exhaust air regulating valve, the gas in the cavity of the cylindrical cylinder liner is discharged from the air-exhaust slot via the third exhaust vent through the first exhaust vent and the second exhaust vent in the meantime, accelerating the exhaust velocity.

14. The device of claim 13 wherein, the pumping drainage device is featured by, the fixed part is a sucker clamp ring fixing the overflow sucker to the periphery of the cylindrical cylinder liner, when the bottom of the cylindrical cylinder liner abuts against the inner wall end face of the cylindrical shell, the edge of the overflow sucker extending out will tightly fit the inner wall end face of the shell seat.

15. The device of claim 14 wherein, the pumping drainage device is featured by, the overflow sucker is a soft elastic material comprising rubber.

* * * * *